United States Patent [19]

Schultz et al.

[11] Patent Number: 4,795,193

[45] Date of Patent: Jan. 3, 1989

[54] BOOKLET WITH RETURN ENVELOPE

[75] Inventors: Edward R. Schultz; Gerald J. Loehlein; Dennis P. Travers, all of Green Bay; Calvin J. McGregor, DePere; Robert H. Johnstone, Green Bay, all of Wis.

[73] Assignee: Moore Business Forms, Inc., Glenview, Ill.

[21] Appl. No.: 939,890

[22] Filed: Dec. 9, 1986

[51] Int. Cl.[4] ..... B42D 1/00

[52] U.S. Cl. ..... 281/15 R; 281/3 R

[58] Field of Search ..... 281/3, 3 R, 15 R; 229/68 R, 68 C, 72, 74, 92.1; 156/201, 202, 204, 226, 227, 291, 364

[56] References Cited

U.S. PATENT DOCUMENTS

| | | | |
|---|---|---|---|
| 391,299 | 10/1888 | Chadwick | 281/3 R |
| 2,145,500 | 1/1939 | Townsend . | |
| 2,180,551 | 11/1937 | Sawdon et al. | 281/3 R |
| 3,369,732 | 2/1968 | Hanson . | |
| 3,460,744 | 8/1969 | Turkenkopf . | |
| 3,911,818 | 10/1975 | McIlvaine . | |
| 4,492,306 | 1/1985 | Cooper et al. | 281/15 R |

FOREIGN PATENT DOCUMENTS

| | | | |
|---|---|---|---|
| 938632 | 12/1973 | Canada | 281/3 R |
| 621268 | 10/1935 | Fed. Rep. of Germany | 281/3 |
| 468634 | 7/1937 | United Kingdom | 281/3 |

*Primary Examiner*—Paul A. Bell

*Attorney, Agent, or Firm*—Cushman, Darby & Cushman

[57] ABSTRACT

A booklet having a spine constituted by serial pasting of like marginal regions of the pages is provided with a pasting gap at an intermediate site along the spine between two of the booklet pages. An envelope is thereby left with an end margin caught in the pasting gap. In order to ensure that this envelope remains in place until it is intentionally removed, a spot of adhesive is provided between at least one face of the end margin of the envelope and the spine of one envelope-confronting page of the booklet within the pasting gap. The envelope is easily intentionally removed by opening the booklet to the site of the envelope and tugging outwards, away from the spine, in order to sever the localized facial connection of the envelope to the booklet that was provided by the spot of adhesive. By preference, a discard strip bordering the glue flap of the envelope is cut away by performing a die cutting step as the envelope is being manufactured, so that the envelope web can be aligned with the page webs along one longitudinal margin, yet not be pasted into the booklet spine. Also by preference, the booklet is organized in a manner such that its use is facilitated by grasping the two faces of the pasting gap and pulling it apart into two sub-booklets.

9 Claims, 2 Drawing Sheets

BOOKLET WITH RETURN ENVELOPE

BACKGROUND OF THE INVENTION

The present invention relates to a booklet having a spine constituted by serial pasting of like marginal regions of the booklet pages, and in which an initially sufficiently securely held return envelope is easily detachable from the spine.

Quite frequently income tax form booklets and other business forms are constituted by a series of pages arranged in a stack, with the pages serially bound to one another in a spine by bands of adhesive which extend along like marginal regions of all but the first or last of the pages. In such booklets, it is common to provide for the individual detachment of one or more (but less than all) of the booklet pages from the spine, e.g. by providing a line of weakness (e.g. a line of perforations) running along each respective page parallel to and closely adjacent to the pasted spine.

Accordingly, each page which is separated from the booklet by severing it from the spine along the respective line of weakness is shorter than the booklet in the direction normal to the length of the spine, by an amount equal to the width of the spine.

It is very convenient for such a booklet to be accompanied by a return envelope, i.e. one which the booklet recipient can use for returning to the booklet sender one or more of the pages which the recipient has detached along the respective line or lines of weakness, often after the recipient, following instructions provided in the booklet, has entered information on one or more of those pages and attached other sheets it to (e.g. annual income payment statements, and a tax balance payment check).

Many ways have been devised for temporarily uniting a return envelope with such a booklet. One way known in the art is to bind the return envelope into the spine of the booklet just as if it were another sheet of the booklet, and to provide for detachment of the envelope from the spine by providing it with a line of weakness running along the inner edge of the spine, so that it may be detached in the same way that pages may be removed from the booklet, as described above.

Presently, many booklets such as tax form booklets sent to individuals have some pages that are printed with subject matter that is common to all of the similar booklets that the sender is sending to many individuals in a particular mass mailing, and other pages which contain at least some customised printed information (and possibly, even usually, some common printed information). Such booklets and a way of printing them are disclosed in the U.S. Pat. No. 3,911,818, of MacIlvaine issued Oct.14, 1975.

In the high speed production of pasted spine-type booklets having some removable pages and a detachable return envelope, particularly when the booklets contain a mixture of fixed and variable data, and particularly where the booklet manufacturing method is carried out by pasting and assembling corresponding portions of a plurality of webs of indeterminate length, then severing the assembled composite transversally of its direction of travel, into a succession of individual booklets, there is a disadvantage to trying to assemble preformed individual return envelopes to the composite web or to the individual booklets, and a corresponding advantage to forming the return envelopes from a pasted and plow-folded intermediate continuous web simultaneously with pasting and assembly of the page webs to form the series of booklets.

However, it should be apparent that in instances in which the return envelopes made in such a way are pasted into the booklet spines and made detachable along lines parallel to the spines, the interior widths of the envelopes will be smaller than the widths of the detached pages meant to be returned in them (unless the page spine stubs are made broader than the return envelope spine stubs, which can be awkward and wasteful of material). In such cases, the detached pages must be folded not only in a J, V, C or Z fold in one direction, but also at least J-folded along an axis normal to that of the first folds before they can be inserted in the return envelope by the booklet recipient.

SUMMARY OF THE INVENTION

A booklet having a spine constituted by serial pasting of like marginal regions of the pages is provided with a pasting gap at an intermediate site along the spine between two of the booklet pages. An envelope, preferably one fabricated of printed, pattern pasted, plow-folded and transversally severed web stock as a series of the booklets is being manufactured from a plurality of printed, across-the-web pasted and pressed together then transversally severed webs, is thereby left with an end margin caught in the pasting gap. In order to ensure that this envelope remains in place until it is intentionally removed, a spot of adhesive is provided between at least one face of the end margin of the envelope and the spine of one envelope-confronting page of the booklet within the pasting gap. The envelope is easily intentionally removed by opening the booklet to the site of the envelope and tugging outwards, away from the spine, in order to sever the localized facial connection of the envelope to the booklet that was provided by the spot of adhesive. By preference, a discard strip bordering the glue flap of the envelope is cut away by performing a die cutting step as the envelope is being manufactured, so that the envelope web can be aligned with the page webs along one longitudinal margin, yet not be pasted into the booklet spine. Also by preference, the booklet is organised in a manner such that its use is facilitated by grasping the two faces of the pasting gap and pulling it apart into two sub-booklets.

The principles of the invention will be further discussed with reference to the drawings wherein a preferred embodiment is shown. The specifics illustrated in the drawings are intended to exemplify, rather than limit, aspects of the invention as defined in the claims.

DETAILED DESCRIPTION

Figure 1:
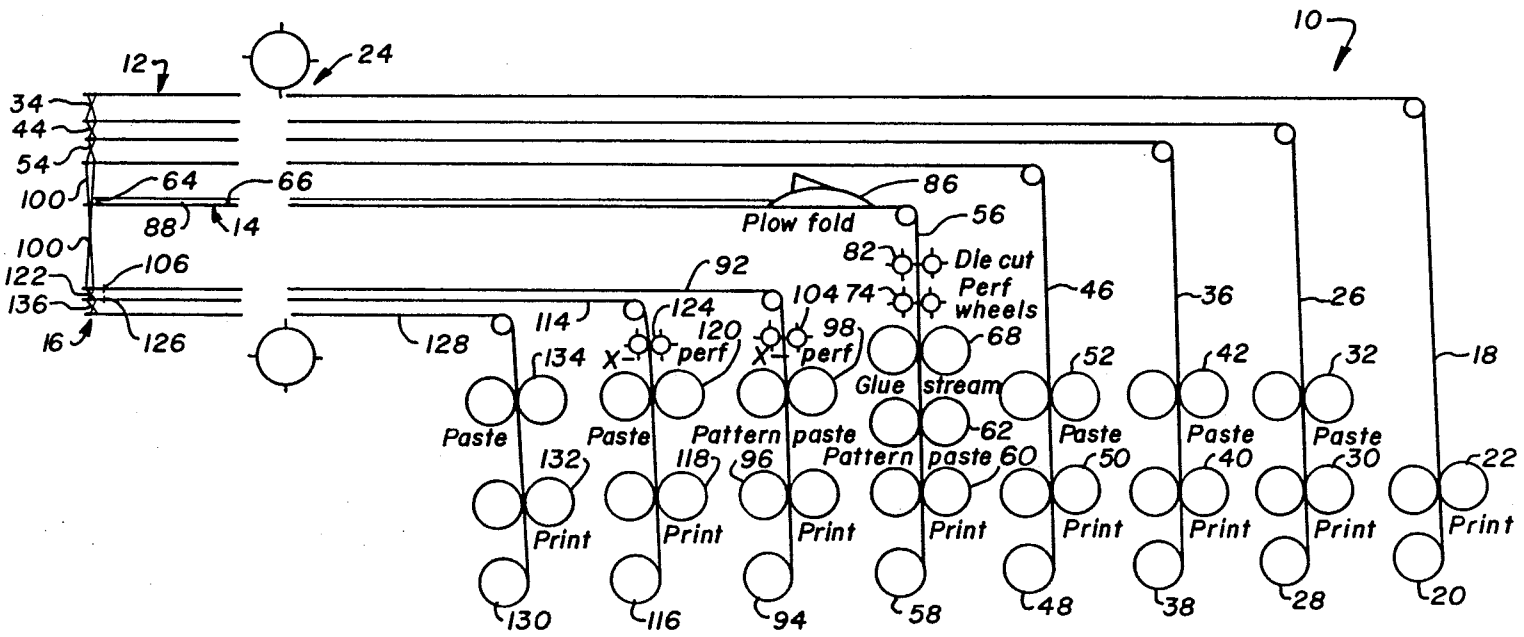
FIG. 1 is a schematic side elevational view of a production line for producing the booklet with return envelope of the present invention in a preferred practice using web stock to produce a series of such booklets, one of which is illustrated at the left.
Figure 2:
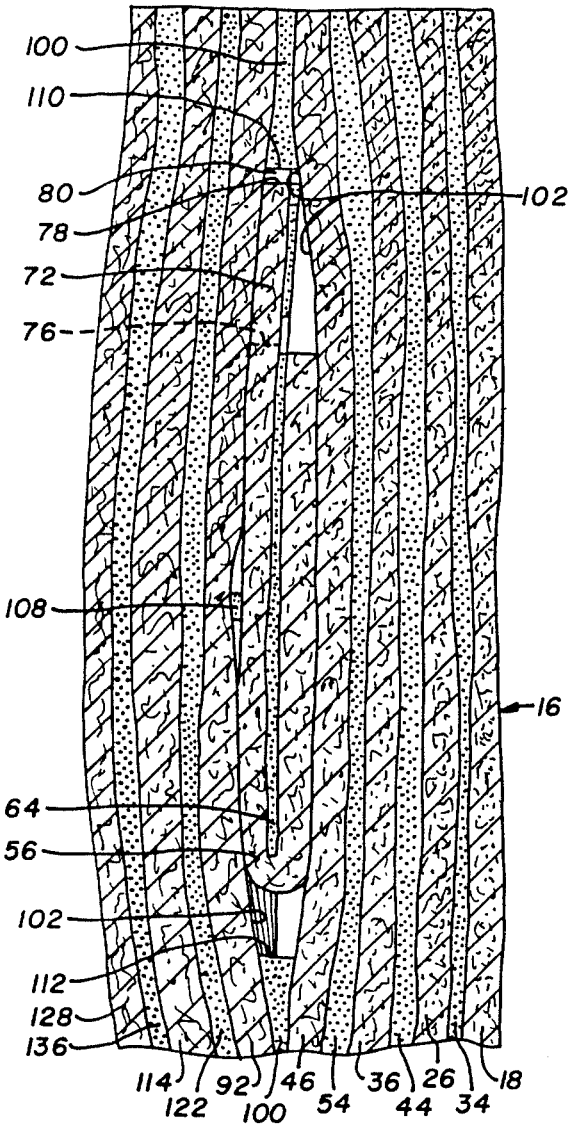
FIG. 2 is a fragmentary thickness-exaggerated spine-exterior elevational view of a booklet with envelope embodying principles of the present invention.
Figure 3:
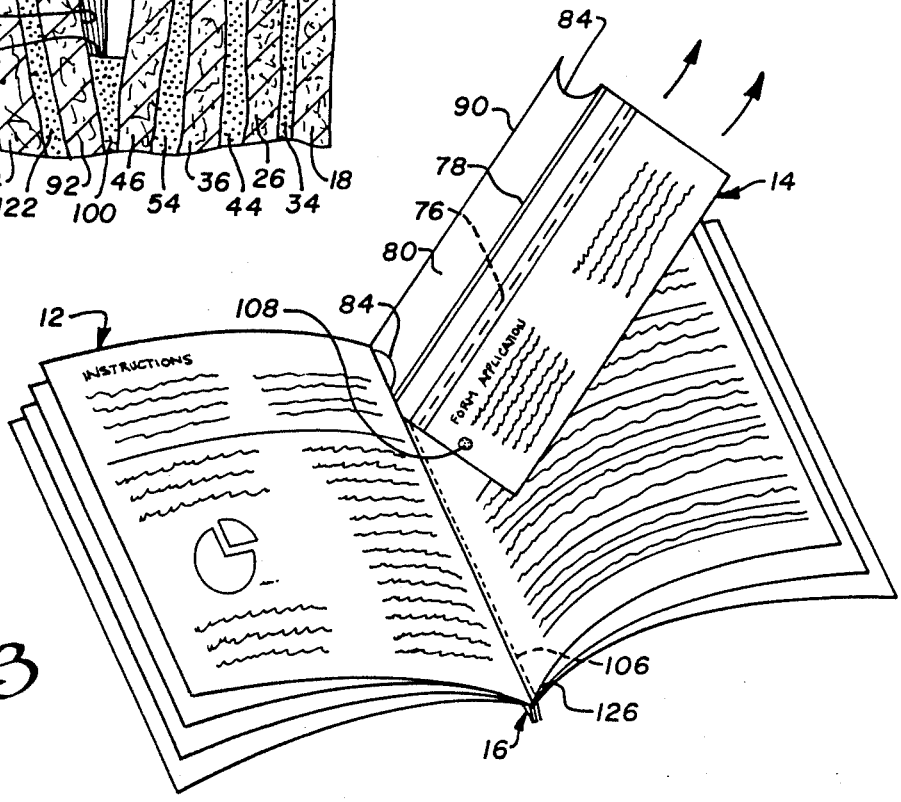
FIG. 3 is a perspective view of the booklet, open to the page where the return envelope was lodged in the pasting gap of the spine, showing the return envelope in the process of being tugged to remove it from the booklet.

In FIG. 1, a production line is schematically illustrated at 10 for producing a series of booklets, one of which is illustrated at 12. (The production line is shown in side elevation running longitudinally to the left.) In this instance, eight webs of paper or the like are processed on the line, to produce a fourteen face (seven sheet) booklet 12 and an envelope 14 having an end margin removably lodged in the spine 16 of the booklet. This layout is typical or exempliary. The booklets could have more or fewer pages. (There is some disparity in the trade in the use of the term "page", i.e. whether it designates a sheet or a face. In this document, unless the contrary is clear from the context, the term "page" will be used to designate a sheet, and the term "face" will be used to designate a face of a sheet.) More than one return envelope could be lodged in the spine of each booklet. The envelope could itself initially contain contents. An operation shown being fully executed at one site may be begun at one site and completed at a physically separated site. The booklets could be produced by a production line that has the sequence of webs reversed, and, so long as the web (or webs) used for producing the envelopes is (or are) intermediate and not at either extreme, such web (or webs) need not be approximately central. Operations shown occurring on-line could be performed off-line. Some webs may be made of different material than others, e.g. different grades or weights of paper, some with carbon or carbonless transfer material coated on the back, or provided as an interleaving. With these suggestions and the disclosure provided herein, other possibilities for modification and opportunities for use may easily suggest themselves to persons skilled in the art.

For convenience in manufacture, it is preferred that the booklets, if edge bound, be produced on the composite web so that the left-to-right direction of the booklet is aligned with the longitudinal direction of the composite web. (In other words, the booklets, until being severed from the web are serially joined left edge to right edge, rather than head edge to foot edge.)

In FIG. 1, at the right, a first web 18 is shown being unrolled at 20, printed on either or both faces at 22 and advanced to an assembling and cutting station 24.

A second web 26 is shown being unrolled at 28, printed on either or both faces at 30, periodically pasted at 32 with an across-the-web glue line 34 on its first face (the one which will confront the first web 18), and advanced to the assemblinq and cutting station 24 in aligned, underlying relation to the first web 18.

A third web 36 is shown being unrolled at 38, printed on either or both faces at 40, periodically pasted at 42 with an across-the-web glue line 44 on its first face (the one which will confront the second web 26), and advanced to the assembling and cutting station 24 in aligned, underlying relation to the second web 26.

A fourth web 46 is shown being unrolled at 48, printed on either or both faces at 50, periodically pasted at 52 with an across-the-web glue line 54 on its first face (the one which will confront the third web 36), and advanced to the assembling and cutting station 24 in aligned, underlying relation to the third web 36.

A fifth web 56 is shown being unrolled at 58, printed on ether or both faces at 60 longitudinally provided at 68 with a glue stream 70 of rewettable glue on the margin of what will become a glue flap 72 thereof, transversally pattern-pasted on one face 62 to provide the envelope end-forming glue strips 64, 66, longitudinally provided at 74 with lines of weakness (respectively for defining the envelope body-connected margin of the glue flap 72 and for defining what will become the free edge margin of the glue flap 72 after the booklet recipient has taken the envelope from the booklet and removed the marginal discard strip 80, e.g. in accordance with instructions printed at 82). Next, the fifth web 56 is plow-folded at 86 along a longitudinal line lying nearly midway between the line of weakness 76 and the opposite longitudinal edge of the fifth web from the one disposed on the discard strip 80. The direction of the folding is such as to place the glue strips 64, 66 on the inside of the thus doubled-over portion of the fifth web 56, thus dividing that doubled-over portion of the fifth web 56 into a longitudinally extending series of envelope pockets 88. Each of the pockets 88 has an interior dimension, running longitudinally of the fifth web, that is preferably sufficient to permit the pocket to receive, without need for biaxial folding, contents which will be described herein below.

Next, the discard strip 80 region of the fifth web 56 is periodically die-punched at 82 to remove (along the line 84) an axially short, e.g. oval shaped, full-width segment thereof centered upon and spanning each imaginary across-the-web line at which the fifth web 56 will be severed at the assembling and cutting station 24. The amount of material removed at 84 is sufficiently long, longitudinally of the fifth web 56, downstream of the above-mentioned imaginary line it spans, that when the end margin of the envelope 14 is lodged in the pasting gap of the spine 16 (as is described hereinbelow), the adjacent end of the discard strip 80, formed by a respective portion of the line 84, terminates short of the spine 16 and therefore is neither lodged in the pasting gap nor pasted into the spine. (Of course, in less preferred practices of the invention, the die cutting step could be omitted and the end margin of the discard strip 80 either lodged in the pasting gap or pasted into the spine.) The fifth web 56, is advanced to the assembling and cutting station 24 with its one edge 90 (the one on the discard strip 80) in vertical registry with the corresponding edges of the other seven of the webs, the folded fifth web 56 being disposed at the assembling and cutting station 24 in aligned, underlying relation to the fourth web 46.

A sixth web 92 is shown being unrolled at 94, printed on either or both faces at 96, pattern pasted at 98 with an across-the-web glue line 100 which is different from the across-the-web glue lines which have been described hereinbefore in relation to the second, third and fourth webs, in that it is discontinuously provided so as to be missing in an intermediate region 102 the placement and length of which correspond to where the end margin of a respective envelope 14 is lodged in the margin of the respective spine 16. At a perforating station 104 the sixth web 92 is provided with an across-the-web perforation line 106 which lies slightly more medially of the page than the line of adhesive applied at 98. Then the sixth web is advanced to the assembling and cutting station 24 in aligned underlying relation to the fourth web 46, with the glue line 100 confronting the fourth web 46, the plow-folded fifth web being sandwiched between the fourth and sixth webs so that it extends through the pasting gap 102.

By preference, the plow-folded fifth web is removably adhesively tacked to the fourth web or to the sixth web, preferably in the spine 16, preferably by a portion of the adhesive which is applied to the sixth web 92 at 98. By preference, the gap 102 in the adhesive line 100 is slightly larger, across the web, than the corresponding dimension of the folded fifth web 56 which is sandwiched in the spine portion contributed by the confrontation of the fourth and sixth webs, and the adhesive tacking is provided by a small spot of adhesive 108 which is applied to the sixth web simultaneously with and using the same adhesive as the adhesive applied at 98. This spot lies between the ends 110 and 112 of, but is spaced between the ends of the adhesive 100, in the pasting gap 102. (However, the adhesive 108 could be a different adhesive, could be applied instead to the confronting face of the fourth web, could be located elsewhere than directly in the pasting gap 102, could be a plurality of spots, and could in some instances be contiguous with either or both of the ends 110, 112, or omitted entirely.

A seventh web 114 is shown being unrolled at 116, printed on either or both faces at 118, periodically pasted at 120 with an across-the-web glue line 122 on its first face (the one which will confront the sixth web 92), at a perforating station 24 provided with a across-the-web perforation line 126 which lies slightly more medially of the page than the line of adhesive applied at 120. Then the seventh web is advanced to the assembling and cutting station 24 in aligned underlying relation to the sixth web 92.

An eighth web 128 is shown being unrolled at 130, printed on either or both faces at 132, periodically pasted at 134 with an across-the-web glue line 136 on its first face (the one which will confront the seventh web 114), and advanced to the assembling and cutting station 24 in aligned underlying relation to the web 114.

At the assembling and cutting station 24, the assembled, aligned stack of first through eighth webs (the folded fifth web being aligned along only one margin, as explained above), is pressed together to create a composite web on which corresponding sites on the confronting faces of the various individual webs are adhered together along the various across-the-web glue lines (and the adhesive spot), which have been described. (The longitudinal glue stream line 70 remains unwetted and non-adhered to a confronting web at this time.) Also at the station 24, the resulting composite web is periodically successively cut transversally thereof, through the full thickness thereof on the opposite side of each spine 16 from the adjacent perforation lines 106 and 126 in order to divide the composite web into a succession of individual booklets 12, each having an envelope 14 removably lodged in its spine, in the pasting gap between its fourth and sixth pages.

In order to maintain the various webs in alignment from when they are unrolled until the booklets are severed from the composite web, the various webs may be conventionally provided along their two lateral margins (or either of them) with respective rows of pin feed holes (not shown), on marginal strips (not shown) which are separable from the main portions of these webs, for instance at the station 24, along respective longitudinally extending perforation lines (not shown). In other instances, these feeding-facilitating elements may be omitted and feeding accomplished by frictional engagement with the web faces, guiding engagement with web edges, and alignment by photoelectric sensing of printed alignment marks. In other instances, the feed-facilitating pin feed hole-provided marginal strips may be provided and the station 24 may be simply an assembling and pressing station, with the composite web, with the marginal strips still attached being simply boxed and supplied to the forms manufacturer's customer as a stock of indeterminate length for the customer to later separate in booklets and detach the marginal strips from, e.g. after applying further printing to the form stock.

When the recipient of an individual booklet receives it, following instructions, he or she opens it to between the pages provided by the fourth and sixth webs, and tugs the envelope to remove its end margin from the spine of the booklet, and in the course of doing so, shearing the connection which was provided by the glue spot 108. The user then following instructions, removes and discards the discard strip 80 from the glue flap of the envelope.

Should the user wish, the user can easily split the booklet into two sub-booklets, by inserting his or her fingers into the spine's pasting gap from which the envelope end margin was removed, and pulling apart. In this manner, the user may e.g. separate a tax form booklet into a first sub-booklet which contains all of the instructions, and a second sub-booklet which contains the work sheets, tax forms, schedules and tax table.

The sheets which are to be returned to the sender in the envelope 14 are the ones which can be detached from the spine 16 along the lines of weakness 106, 126. The width of these pages, following their detachment along the lines 106, 126 preferably is less than the internal end-to-end dimension of the respective envelope pocket 88, so that these pages, together with W-2 forms, a check and/or the like can be unidirectionally folded, (i.e. without a need for both lengthwise and crosswise folding) placed in the pocket, and the envelope flap folded over and its glue line 70 wetted to seal the envelope.

It should now be apparent that the booklet with return envelope as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A booklet having:

a spine of predetermined length, said spine being constituted by serial adhesion by means of respective interfacial lines of adhesive, of like first marginal regions of a plurality of pages, each said page being of predetermined length and width; said booklet having a pasting gap provided in a respective one of said lines of adhesive at an intermediate site along said spine between said first marginal regions of two adjacent ones of said pages, said pasting gap being shorter than the length of said spine;

an envelope of predetermined length and width, said envelope being removably received in said booklet between said two adjacent pages, with an end margin thereof removably lodged in said pasting gap;

said booklet having a first edge running along said spine, a second opposite edge parallel thereto and a pair of third and fourth edges running perpendicular to said spine, and said envelope, while lodged in said spine having one end disposed substantially flush with said first edge of said booklet and a second end disposed substantially flush with said second edge of said booklet;

said end margin of said envelope, in a direction parallel to the length of said spine, being shorter than said spine.

2. The booklet of claim 1, further including:

a spot of adhesive provided between and removably connecting said envelope with one of said two adjacent pages.

3. The booklet of claim 2, wherein:

said spot of adhesive is located in said pasting gap.

4. The booklet of claim 1, wherein:

at least some of said pages of said booklet are each provided with a respective line of weakness running parallel to and adjacent said spine to facilitate selective detachment of respective portions of such pages from said spine, said envelope thereby being wider than said respective portions of such pages.

5. The booklet of claim 5, wherein:

said envelope has a pocket provided with an internal end-to-end dimension which is greater than the width of each of said selectively detachable page portions so that such pages may be detached and placed in said envelope upon removal of said envelope from said booklet without need for bidirectional folding of such pages.

6. The booklet of claim 5, wherein:

at least one page of said booklet is a cover, said selectively detachable page portions are grouped in said booklet between said cover of said booklet and said envelope, and said booklet is arranged to be split into two sub-booklets by shearing said spine along an imaginary plane containing said pasting gap.

7. The booklet of claim 4, wherein:

at least one page of said booklet is a cover, said selectively detachable page portions are grouped in said booklet between said cover of said booklet and said envelope, and said booklet is arranged to be split into two sub-booklets by shearing said spine along an imaginary plane containing said pasting gap.

8. The booklet of claim 1, wherein:

said envelope has a body provided with a pocket and a glue flap hinged along an edge thereof to said body; a discard strip connected along an edge thereof to said glue flap, but being separable therefrom along a line of weakness, said discard strip having a free edge aligned with one of said third and fourth edges of said booklet.

9. The booklet of claim 8, wherein:

said discard strip has a first end which terminates short of said end margin of said envelope and is free of said spine of said booklet.

* * * * *